United States Patent [19]

Richter

[11] 4,028,171

[45] June 7, 1977

[54] METHOD FOR CONTINUOUS TREATMENT OF FIBER MATERIAL IN A VERTICAL ARRAY

[75] Inventor: Johan C. F. C. Richter, St. Jean Cap Ferrat, France

[73] Assignee: Kamyr Aktiebolag, Karlstad, Sweden

[22] Filed: July 2, 1975

[21] Appl. No.: 592,659

[30] Foreign Application Priority Data

July 5, 1974 Sweden ..... 7408858

[52] U.S. Cl. ..... 162/19; 162/237; 162/241; 162/246; 23/290.5

[51] Int. Cl.[2] ..... D21C 3/26; D21C 3/24

[58] Field of Search ..... 162/17, 19, 40, 237, 162/239, 246, 248, 251, 37, 241, 242; 23/290.5, 280, 283; 68/181 R; 426/511

[56] References Cited

UNITED STATES PATENTS

| | | | |
|---|---|---|---|
| 1,813,205 | 7/1931 | Scholz et al. | 162/246 |
| 2,614,923 | 10/1952 | Turkkonen | 162/52 |
| 2,653,084 | 9/1953 | Greenbank | 23/290.5 |
| 2,730,888 | 1/1956 | Seely et al. | 68/181 R |
| 2,776,894 | 1/1957 | Kruse | 426/511 |
| 3,007,839 | 11/1961 | Richter | 162/17 |
| 3,380,883 | 4/1968 | Richter et al. | 162/19 |
| 3,441,475 | 4/1969 | Tomlinson | 162/237 |
| 3,619,348 | 11/1971 | Asplund | 162/19 |
| 3,660,225 | 5/1972 | Verieyne | 162/17 |
| 3,811,994 | 5/1974 | Ostberg | 162/237 |

FOREIGN PATENTS OR APPLICATIONS

| | | | |
|---|---|---|---|
| 688,940 | 6/1964 | Canada | 162/246 |
| 2,361,627 | 6/1974 | Germany | 162/237 |

*Primary Examiner*—S. Leon Bashore
*Assistant Examiner*—Steve Alvo
*Attorney, Agent, or Firm*—Cushman, Darby & Cushman

[57] ABSTRACT

A method for continuous treatment of fiber material in a digestor or the like that allows substantial segregation of the digestor treatment zones so as to prevent upflow of liquid from a bottom zone to an upper zone. An area of reduced cross-sectional area is provided between each treatment zone which increases the velocity of flow of fiber material and entrained liquid in that area, and substantially prevents upward movement of liquid therepast.

5 Claims, 2 Drawing Figures

METHOD FOR CONTINUOUS TREATMENT OF FIBER MATERIAL IN A VERTICAL ARRAY

BACKGROUND AND SUMMARY OF THE INVENTION

The invention relates to a method and apparatus for continuous treatment of fiber material in a vertical array in general, and in particular to continuous pulp digestors having a plurality of treatment areas therein, such as impregnation, cooking, and washing areas, etc.

A conventional type of continuous digestor is shown in U.S. Pat. No. 3,380,883, and Swedish Pat. No. 334,809, shows another type of prior art digestor having a separate impregnation vessel. In practice, in a conventional continuous digestor, a feeder feeds in fiber material from a steaming vessel to the top of the digestor —the impregnation zone thereof — via a transfer line which goes from the feeder to the digestor, and a return line back to the feeder from the top of the digestor is provided. Since the feeder is connected on one side thereof to a low pressure system — the steaming vessel — the temperature of the return liquid from the top of the digestor — which is part of the high pressure system — must not be changed any significant degree during separation of the fiber material from the transfer liquid in the digestor top. If the transfer liquid temperature does rise significantly — as it may if liquid from the lower zones of the digestor, which is hotter than the liquid in the impregnation zone, moves by convection to the top of the digestor — then damage to the steaming apparatus may ensue, with subsequent interruption of the operation of the digestion system. Under many circumstances it is also helpful to isolate to the extent possible the temperature and pressure conditions in each treatment zone of a vertically arranged digestor.

According to the present invention a method and apparatus are provided for minimizing heat (and pressure) transfer between treatment zones to prevent damage to steaming apparatus, or other adverse consequences. This is accomplished in general, according to the present invention, by forcing fiber material from an upper treatment area into a lower treatment area at increased velocity so that liquid from the lower treatment area may not move by convection into the upper treatment area. This may be provided in part by an area of reduced cross-section arranged between the zones to be separated.

It is the primary object of the present invention to provide a method and apparatus for the substantial segregation of the temperature and pressure conditions in adjacent zones of a vertical continuous digestor or the like. This and other objects of the invention will become clear from an inspection of the detailed description of the invention, and from the appended claims.

DETAILED DESCRIPTION OF THE DRAWING

Figure 1:
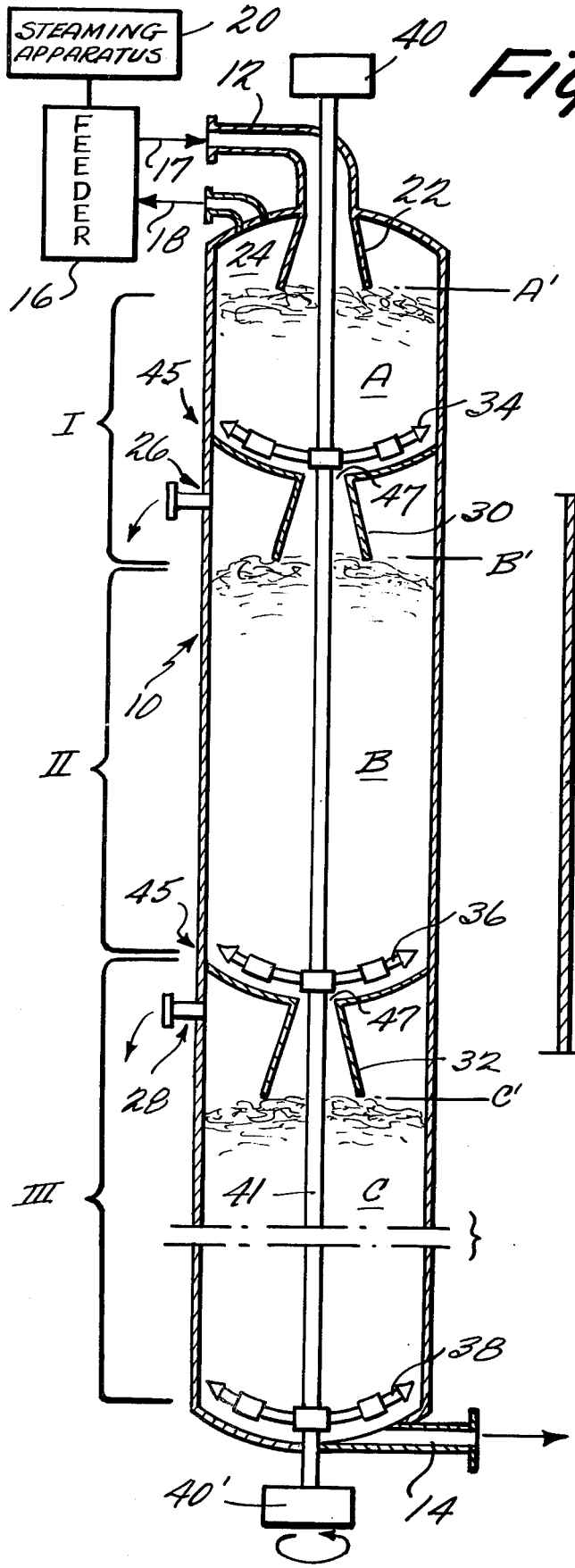
FIG. 1 is a schematic side cross-sectional view of a continuous treatment vessel having exemplary apparatus according to the present invention for practicing the method of the present invention.

A continuous treatment vessel, or digestor, for practicing the method of the present invention and including apparatus according to the present invention is shown generally at 10 in FIG. 1. The digestor 10 is vertically arranged and includes an inlet 12 located vertically above an outlet 14. As is conventional, the inlet 12 may be connected to a conventional feeder 16, a line 17 from feeder 16 extending to outlet 14, and a return line 18 (outlet) extending from the top of digestor 10 to the feeder 16. The feeder 16 is in turn connected to a conventional steaming means 20 or the like. Fiber material fed in through inlet 12 forms a first column A with top level A′ in the digestor by flowing through funnel 22 located concentrically in the digestor 10. Transfer liquid forms in the area 24 above fiber column level A′ to be transported back to feeder 16 through line 18, and it is the temperature of this liquid which must be held generally constant to prevent damage to the steaming means 20 or the like.

The digestor 10 may include a plurality of treatment zones or chambers including a feed-in or impregnation zone I, a cooking zone II or the like, and a washing zone III or the like. Any number of other zones may also be provided, as indicated by the broken lines in FIG. 1. The temperature and pressure conditions in each succeeding zone are often quite different, of course, depending upon the particular treatment steps being practiced in each given zone. For instance, often the temperature in zone I is on the order of 110° C, while in zone II if the sulphate process is employed, may be about 170° C. Thus, if liquid from zone II could flow upwardly by convection to zone I, it could result in heating of the liquid in area 24, with consequent adverse results. Of course, any conventional treatment steps or processes may be performed in the various zones including impregnation, cooking, washing, bleaching, cooling, chemical and semi-chemical treatment processses including sulphate, hydrolizing, neutral sulphite, and bisulphite processes. A retention time in any given zone may be provided by adjusting the flow conditions, etc. Each zone may be of modular construction, and the zones bolted together to provide an arrangement with great flexibility as far as treatment steps that may be performed thereby.

A fiber column is established in each zone, such as column A in zone I, column B in zone II, and column C in zone III. Each of the zones is liquid filled, and liquid may be introduced therein by any suitable conventional means, which means are not shown in the drawings since the exact details thereof are not important for the present invention. Normally liquid will be introduced near the bottom of the zone and will flow upwardly, countercurrent to the fiber material flow, past the level (A′., B′, C′ ) of the fiber material within a zone. In each zone, above the fiber level (A′, B′,C′) there is an area that is just filled with liquid, and liquid is continuously extracted therefrom (and recirculated and/or chemically treated), as by conventional outlet means 18, 26, and 28, which may comprise a plurality of circumferentially arranged outlets, While screens may be provided at the outlets 18, 26, 28, screens have a tendency to clog, and the use thereof should be avoided if possible. According to the present invention, since the fiber material from each upper stage is transported to each consecutive lower stage by a funnel 22, 30, 32 or the like, and consequentially since the outlets are located well above the highest area of introduction of fiber material within the given zone, the use of screens is avoided.

The fiber material flows downwardly through the digestor into each succeeding zone under the influence of gravity at a given velocity, and scraper means 34, 36, and 38 may also be provided to assist in the downflow of the fiber material and the movement thereof from one zone to the next or from the last zone to the outlet 14. The scraper means may be driven by power means 40 and/or 40' by shaft 41 or the like. The shaft 41 may be continuous or in section (see FIG. 2), and power means 40, 40' or the like for rotating the shaft may be located at any suitable point therealong. The scraper 38, as is conventional in washing zones and the like, may be hollow and have nozzles therein for directing liquid upwardly through the zone III, or a separate means besides scraper 38 may be provided for this purpose. As mentioned above, other liquid introducing means may also be employed.

In order to prevent upflow of liquid from one zone to an adjacent upper zone, means 45 are provided. Such means 45 comprises generally an area of reduced corss-sectional area from one zone to the next, and in particular may include a bottom wall 46 of zone I being sloped gradually downwardly (being conically or spherically curved) and having an opening 47 formed in the bottom thereof, which opening is of smaller cross-sectional area than the cross-sectional area of the zones it interconnects. Similar walls and openings may be provided between zones II and III if desired, and between any subsequent zones. The opening 47 forms the mouth area of funnel 30, the discharge area 31 of funnel 30 being located just above level B-B'. The means 45, by virtue of the fact that it provides a reduced flow cross-section for fiber material and entrained liquid, provides for an increased velocity of flow of the material and entrained liquid, the flow being great enough to substantially prevent upward flow of liquid from zone II to zone I countercurrent thereto.

Figure 2:
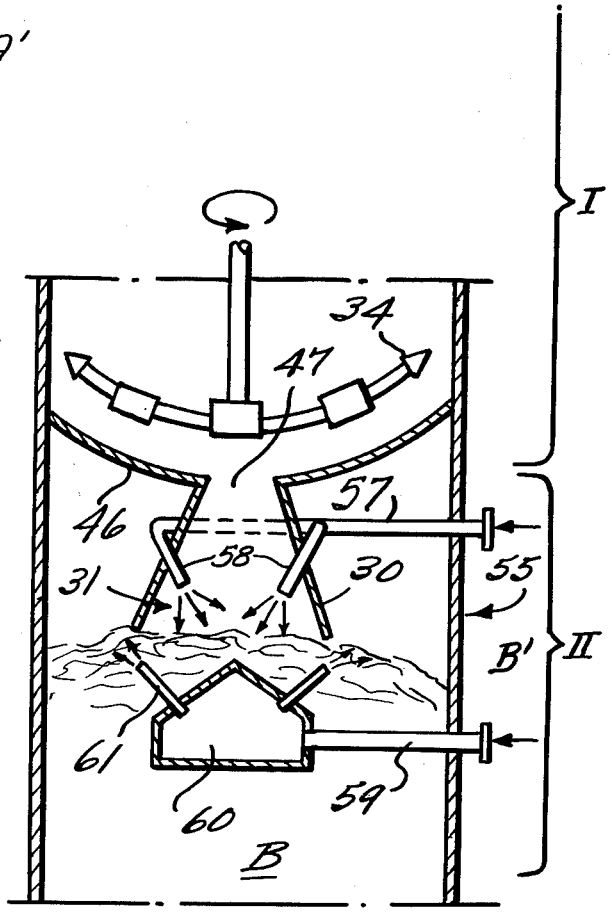
FIG. 2 is a detail schematic side sectional view of exemplary apparatus according to the present invention as shown in FIG. 1 with accessory apparatus associated therewith.

As shown in FIG. 2, additional means may also be provided adjacent the area of the transitions between zones. Such means may be for applying fluid (steam, gas, or liquid) in the general area of the region of reduced cross-sectional area between adjacent zones for treatment of the fiber material and for facilitating downward movement of the fiber material and prevention of liquid flowing upwardly to funnel area 31. Such means, shown generally at 55 in FIG. 2, may include a pipe 57 with downwardly directed nozzles 58 in funnel 30 for introducing hot fluid on top of fiber column B and directly into fiber material flowing through opening 47 to form fiber column B, and a connection 59 and distribution device 60 with nozzles 61 located within the upper portion of the fiber column B, for introducing hot fluid into column B. Nozzles 58 facilitate downward movement of the fiber material through funnel 30 since they entrain fiber material in downwardly directed fluid flowing therethrough, and nozzles 61 assist downward movement be evening the distribution of material flowing into column B so that pilling in the center of the zone is avoided. Also fluid flowing through nozzles 61 will help displace upwardly flowing liquid in zone II to the outlet means 26, rather than directing it upwardly into funnel discharge area 31.

It will thus be seen that according to the method of the present invention, the following steps are practiced: establishing a first fiber column A in a liquid filled upper treatment zone I having first predetermined pressure and temperature conditions and a first cross-sectional area, continuously moving fiber material at a given first flow velocity downwardly from zone I to zone II, zone II having a second cross-sectional area, forcing material in column A into zone II at a second flow velocity greater than the first velocity and of a magnitude great enough to prevent convection flow of liquid from zone II into zone I by forcing the fiber material through an area 45 between zones I and II of smaller cross-sectional area than the first and second cross-sectional areas, and forming a second fiber material column B in zone II.

It will thus be seen that a method and apparatus for continuous treatment of fiber material accomplishing all the objectives of the present invention has been provided. While the invention has been herein shown and described in what is presently conceived to be the most practical and preferred embodiments, it will be obvious to those of ordinary skill in the art that many modifications may be made thereof within the scope of the invention, which scope is to be accorded the broadest interpretation of the appended claims so as to encompass all equivalent structures and methods.

What is claimed is:

1. A method for continuously treating fiber material in a vertical array comprising the steps of a. establishing a first fiber column of a predetermined height in a liquid-filled first upper treatment zone having first predetermined temperature and pressure conditions, and a first given cross-sectional area, b. continuously moving individual fibers of said first fiber column downwardly at a first predetermined flow velocity towards a liquid-filled lower second zone having second predetermined temperature and pressure conditions greater than said first predetermined temperature and pressure conditions, and a second given cross-sectional area, c. forcing individual fibers in said first fibers in said first fiber column from said first zone into said second zone at a second flow velocity greater than said first flow velocity and of a predetermined magnitude great enough to substantially prevent flow of liquid from said second zone into said first zone, by forcing said fiber material through an area between said zones of smaller cross-sectional area than said first and second cross-sectional areas, and d. forming a second fiber column in said second zone.

2. A method for continuously treating fiber material as recited in claim 1 comprising the further steps of continuously maintaining a volume of liquid above said first and second fiber columns in said first and second zones, and continuously extracting liquid from above said first and second fiber columns without screening of said liquid.

3. A method as recited in claim 1 comprising the further steps of continuously moving at a third predetermined flow velocity individual fibers of said second fibers column downwardly towards a liquid-filled lower third zone having a third cross-sectional area, and forcing material in said second fiber column from said second zone into said third zone a fourth flow velocity greater than said third flow velocity and of a predetermined magnitude great enough to prevent flow of liquid from said third zone into said second zone by forcing said fiber material through an area between said second and third zones of smaller cross-sectional area than said second and third cross-sectional area, and forming a third fiber column in said third zone.

4. A method as recited in claim 3 comprising the further steps of introducing fluid into the general areas of reduced cross-section between said first and second zone and said second and third zone for treating the fiber material in said second and third fiber columns, and for facilitating downward movement thereof.

5. A method as recited in claim 1 comprising the further step of introducing fluid into the general area of reduced cross-section between said first and second zones for treating the fiber material in said second fiber column and for facilitating downward movement thereof.

* * * * *